US006180938B1

(12) United States Patent
Crowther et al.

(10) Patent No.: US 6,180,938 B1
(45) Date of Patent: Jan. 30, 2001

(54) OPTICAL SYSTEM WITH A WINDOW HAVING A CONICOIDAL INNER SURFACE, AND TESTING OF THE OPTICAL SYSTEM

(75) Inventors: Blake G. Crowther, Logan, UT (US); Dean B. McKenney, Tucson, AZ (US); Scott W. Sparrold, Tucson, AZ (US); James B. Mills, Tucson, AZ (US)

(73) Assignee: Raytheon Company, Lexington, MA (US)

( * ) Notice: Under 35 U.S.C. 154(b), the term of this patent shall be extended for 0 days.

(21) Appl. No.: 09/187,432

(22) Filed: Nov. 5, 1998

Related U.S. Application Data

(60) Provisional application No. 60/067,914, filed on Dec. 8, 1997.

(51) Int. Cl.[7] ..... H01J 3/14
(52) U.S. Cl. ..... 250/216; 359/642; 244/3.17
(58) Field of Search ..... 250/216, 239; 359/642, 479, 554, 711; 344/3.17; 356/359

(56) References Cited

U.S. PATENT DOCUMENTS

| | | | | |
|---|---|---|---|---|
| 4,195,919 | * | 4/1980 | Shelton | 351/160 R |
| 4,704,011 | | 11/1987 | Mercado | 350/467 |
| 6,018,424 | * | 1/2000 | Morgan et al. | 359/708 |
| 6,025,959 | * | 2/2000 | Moskovich | 359/649 |

OTHER PUBLICATIONS

Donald P. Feder, "Automatic Lens Design Methods", *J. Optical Soc. of America*, vol. 47, No. 10 (Oct. 1957), pp. 902–912.

G. W. Forbes, "Optical system assessment for design: numerical ray tracing in the Gaussian pupil", *J. Optical Soc. of America A*, vol. 5, No. 11 (Nov. 1988), pp. 1943–1956.

Univ. of Arizona, "Design tools for conformal optics," (Oct. 1996), pp. 1–16.

* cited by examiner

*Primary Examiner*—Que T. Le
*Assistant Examiner*—Thanh X. Luu
(74) *Attorney, Agent, or Firm*—David W. Collins; Glenn H. Lenzen, Jr.

(57) ABSTRACT

An optical system includes a window made of a curved piece of a transparent material having an inner surface and an outer surface. The inner surface has a nominal inner surface shape defined by a first conicoidal relationship, and the outer surface has a nominal general aspheric surface shape. The optical system also typically includes a sensor and an optical train on the side of the inner surface of the window. The accuracy of the shape of the inner surface is tested by directing a coherent light beam through a remote focus of the inner surface, reflecting the light beam from the inner surface toward an adjacent focus of the inner surface, reflecting the light beam from a spherical reflector at the adjacent focus of the inner surface and back toward the inner surface, reflecting the light beam from the inner surface back toward the remote focus, and interferometrically comparing the reflected beam arriving at the remote focus with a reference beam.

14 Claims, 4 Drawing Sheets

OPTICAL SYSTEM WITH A WINDOW HAVING A CONICOIDAL INNER SURFACE, AND TESTING OF THE OPTICAL SYSTEM

This application claims the benefit of U.S. Provisional Application No. 60/0671914, filed Dec. 8, 1997, the disclosure of which is hereby incorporated herein by reference.

BACKGROUND OF THE INVENTION

This invention relates to an optical system having a window therein, and in particular to such an optical system used in an aircraft or missile wherein the window is a conformal window.

An optical sensor receives radiated energy from a scene and converts it to an electrical signal. The electrical signal is provided to a display or further processed for pattern recognition or the like. Optical sensors are available in a variety of types and for wavelengths ranging from the ultraviolet, through the visible, and into the infrared. Optical sensors are used in a variety of commercial and military applications. In some applications the optical sensors are fixed in orientation, and in others the optical sensor is movable such as by a pivoting motion to allow sensing over a wide angular range.

The optical sensors generally employ a photosensitive material that faces the scene and produces an electrical output responsive to the incident energy. The photosensitive material and remainder of the sensor structure are rather fragile, and are easily damaged by dirt, erosion, chemicals, or high air velocity. In service, the sensor is placed behind a window through which it views the scene and which protects the sensor from such external effects. The window must be transparent to the radiation of the operating wavelength of the sensor and resist attack from the external forces. The window must also permit the sensor to view the scene over the specified field of regard.

The window would ideally introduce no wavefront aberration at the center of the field of view, other than possibly spherical aberration, particularly if the sensor is an imaging sensor. The thicker and more highly curved is the window, the more likely is the introduction of significant wavefront aberration. A wide variety of sensor windows have been used in various aircraft applications. In many cases such as low-speed commercial helicopters, flat windows are acceptable. Windows that are shaped as segments of spheres are used in aircraft and missile applications, but for these windows the wavefront aberration tends to be high if the gimbal location is not at the spherical center of the window. In all of these window types, if the window must be wide or must project a substantial distance into an airflow to permit a large field of regard, the aerodynamic drag introduced by the window is large.

For applications involving aircraft and missiles operating at high speeds, the window should be relatively aerodynamic such that the presence of the window extending into the airstream does not introduce unacceptably high and/or asymmetric aerodynamic drag to the vehicle. A conformal window is therefore beneficial to reducing drag and increasing the range of the aircraft. Some existing conformal windows introduce large wavefront aberrations into the sensor beam, particularly for high azimuthal pointing angles of the sensor.

An important consideration in achieving acceptable cost of the optical system is that the conformal window must be easily tested for its accuracy of shape, and must also be readily aligned upon mounting in the flight vehicle. The more complex the shape of the conformal window, the greater the challenge in testing and alignment.

There is a need for an improved window to be used in conformal window applications in high-speed missiles and aircraft. The present invention fulfills this need, and further provides related advantages.

SUMMARY OF THE INVENTION

The present invention provides an optical system including a window whose shape is selected to be conformal for aerodynamic purposes and capable of optimization to achieve excellent optical properties. The window is designed to a preselected nominal shape, and the actual fabricated shape is readily determined and compared to the nominal shape to assess whether the actual window is within specified manufacturing tolerances and also whether any inaccuracies may be compensated for with optical compensation systems.

In accordance with the invention, an optical system comprises a window made of a curved piece of a transparent material having an inner surface and an outer surface. The inner surface has a nominal inner surface conicoidal shape whose shape is defined by a first conic sag relationship. The first conic sag relationship may preferably be expressed in the mathematical form $$z=c\rho^2/(1+(1-(1+k)c^2\rho^2)^{1/2},$$

where z is the distance along an axis of symmetry of the surface, ρ is the distance from the centerline to the surface, and k and c are constants. Other equivalent expressions for a conicoidal shape may be used to describe the shape of the inner surface.

The outer surface has a nominal outer surface shape of a general aspheric form, but which may for many useful cases be defined as a second conic sag relationship modified by at least one aspheric term. The second conic sag relationship, which may be modified by at least one aspheric term, is preferably expressed in the mathematical form $$z'=c'\rho'^2/(1+(1+k')c'^2\rho'^2)^{1/2}+Ap'^4+Bp'^6+Cp'^8+Dp'^{10},$$

where z' is the distance along an axis of symmetry of the surface, ρ is the distance from the centerline to the surface, and k', c', A, B, C, and D are constants. Many other mathematic relationships may used to express a general aspheric shape. For the present purposes, such other general aspheric mathematical forms are equivalent to those expressed herein.

Far less desirably, the outer surface may be defined by a first conic sag relationship and the inner surface may be defined by a second conic sag relationship modified by at least one aspheric term. This approach would, however, negate some of the testing and alignment advantages discussed subsequently.

One surface of the window, preferably the inner surface, is therefore necessarily conicoidal to facilitate the testing and alignment described subsequently. The other surface of the window, preferably the outer surface, is selected to have another shape which, in combination with the conicoidal surface of the window, will impart to the window the desired net refraction as part of the optical system. That is, the selection of the one surface as conicoidal is a key to the invention in order to facilitate testing and alignment, and the shape of the other surface is selected in conjunction with the shape of the conicoidal surface to achieve the desired optical performance.

The optical system preferably includes a sensor sensitive to energy of an operating wavelength. The sensor is positioned interiorly to the window, that is, closer to the inner surface of the window than to the outer surface. The transparent material is transparent to energy of the operating wavelength. There is typically in addition an optical train positioned between the inner surface of the window and the sensor to direct the optical beam onto the sensor.

The window is designed so that the nominal inner surface shape is conicoidal in form to facilitate testing and subsequent alignment of the window in an aircraft or other structure. The fact that the conicoidal shape has two focal points, an adjacent focus close to the inner surface and a remote focus further from the inner surface, is used in the testing and alignment. The testing is required because, even though the nominal inner surface shape is designed to a particular nominal relationship, manufacturing operations usually result in some variations in the shape from the idealized nominal shape that is desired. To assess these variations and determine whether they are within acceptable tolerances, the window is conveniently tested by passing a test beam of a two-beam interferometer through the remote focus, reflecting the beam from the inner surface toward the adjacent focus, reflecting the beam from a spherical mirror at the adjacent focus back along generally the same ray path (but which may not be perfectly the same ray path due to defects in the inner surface) to the interferometer, and interferometrically combining the test beam and a reference beam of the interferometer. Defects in the inner surface are indicated by fringe displacements, which may be counted to determine the number of ½ wavelengths by which the inner surface varies from that desired. With this information, it is determined whether the window actual inner surface shape falls within selected tolerance limits. The same principles are also used to align the window as it is mounted in the structure.

The nominal outer surface shape of the window is selected so that, in conjunction with the conicoidal inner surface shape, there is acceptably low aberration of the image as it passes through the window. The nominal outer surface shape is determined using conventional optical design codes. Stated another way, the window nominally is of nonuniform thickness, with the intentional nonuniformity being the basis for intentional shaping of the wavefront as it passes through the window, for minimal aberration.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 1A–1B are perspective views of a missile having a window therein, wherein FIG. 1A shows a chin mounted window and FIG. 1B shows a nose dome window;

DETAILED DESCRIPTION OF THE INVENTION

Figure 1A:
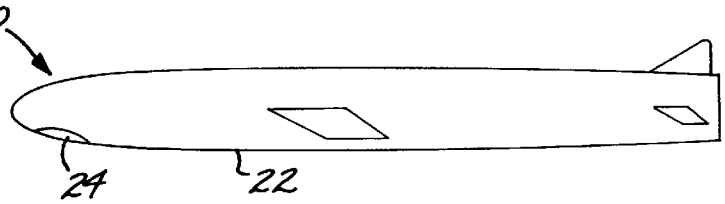
Figure 1B:
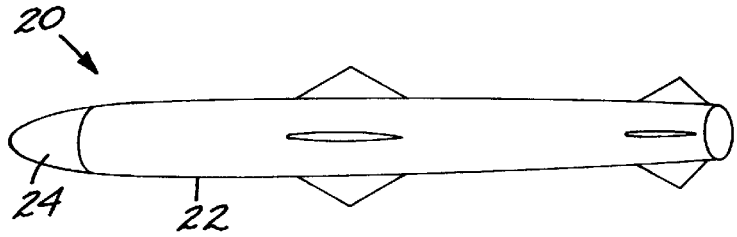

FIGS. 1A–1B depict a flight vehicle, in this case a supersonic missile 20, having a fuselage 22 with a curved window 24 attached thereto. In FIG. 1A, the window 24 is chin-mounted, and in FIG. 1B the window 24 is a nose dome. In each case, the window 24 protrudes partially into the airstream of the missile 20, and therefore may be termed a "dome-type window".

Figure 2:
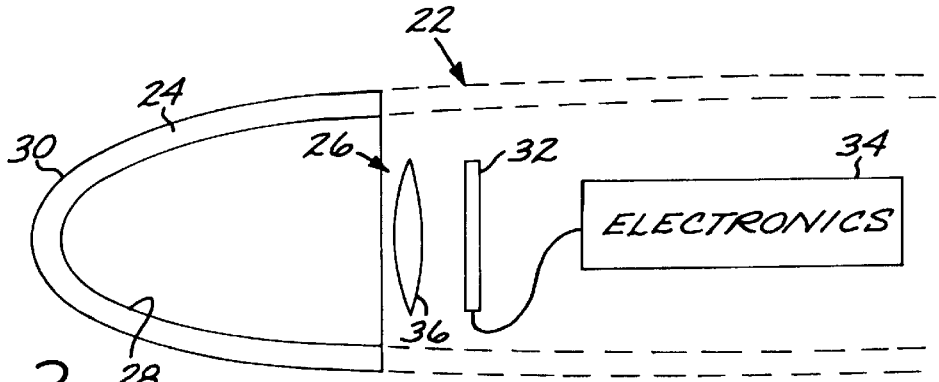
FIG. 2 is a schematic diagram of an optical system according to the invention.

The window 24 is part of an optical system 26, which is shown generally in FIG. 2. The optical system 26 includes the window 24 attached to the fuselage 22. An inner surface 28 of the window 24 is the concave surface of the window 24 that faces the inside of the fuselage 22. An outer surface 30 of the window 26 is the convex surface of the window 24 that faces outwardly and projects into the airstream as the missile 20 flies. The optical system 26 further includes a sensor 32 within the fuselage 22, and thence closer to the inner surface 28 than to the outer surface 30 of the window 24. The sensor 32 is of any operable type which is functional at a preselected wavelength or wavelength range of the incident energy. The output of the sensor 32 is an electrical signal provided to electronics 34, which may be inside the fuselage 22 or remotely located. An optical train 36, schematically indicated by a single lens, is positioned between the inner surface 28 of the window 24 and the sensor 32. The optical train 36 may include reflective elements, refractive elements, and other optical processing elements such as image compensators. The sensor 32, electronics 34, and optical train 36 may be of any operable type, including those known in the art.

Figure 3:
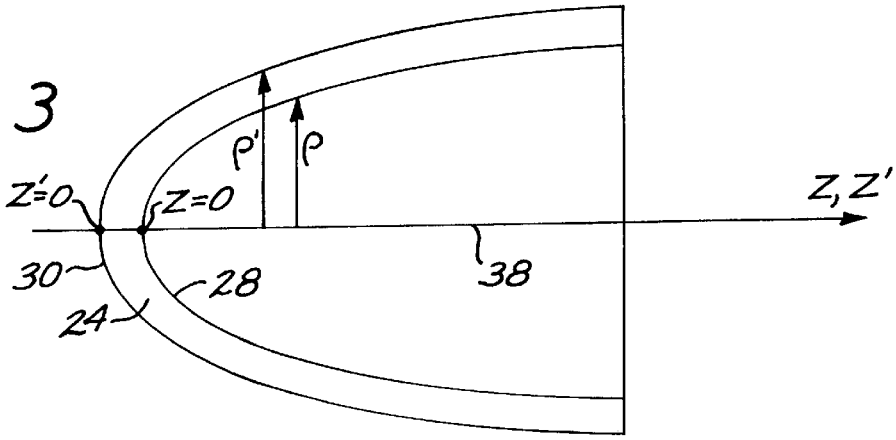
FIG. 3 is a segment of a window.

FIG. 3 illustrates a segment of the window 24 in greater detail. The inner surface 28 of the window 24 is conicoidal, whose shape is defined mathematically by a first conic sag relationship. The first conic sag relationship may preferably be expressed in the mathematical form $$z=c\rho^2/(1+(1-(1+k)c^2\rho^2)^{1/2},$$

where z is the distance along an axis of symmetry 38 of the inner surface 28 (measured from the point at which the inner surface 28 intersects the axis of symmetry 38), ρ is the distance, measured perpendicular to the axis of symmetry 38, from the axis of symmetry 38 to the inner surface 28, and k and c are constants. In a most preferred case, c=0.60626 $in^{-1}$ and k=−0.77011. A useful property of a conicoidal shape is that it has two foci, which property is used to advantage in testing and alignment of the fabricated window.

The outer surface 30 of the window 24 has a nominal outer surface shape whose profile is not conicoidal, and which for many cases may be defined as a second conic sag relationship modified by at least one aspheric term. The second conic sag relationship modified by at least one aspheric term may preferably be expressed in the mathematical form $$z'=c'\rho'^2/(1+(1-(1+k)c'^2\rho'^2)^{1/2}+Ap'^4+B\rho'^6+C\rho'^8+d\rho'^{10},$$

where z' is the distance along the axis of symmetry 38 of the outer surface 30 (measured from the point at which the outer surface 30 intersects the axis of symmetry 38—that is, z and z' are measured from different locations), ρ' is the distance, measured perpendicular to the axis of symmetry 38, from the axis of symmetry 38 to the outer surface 30, and k', c', A, B, C, and D are constants. Many other mathematic forms may used to express a conic sag relationship modified by at least one aspheric term, which forms are equivalent for the present purposes. In a most preferred case using the above relationship, $c'=0.57145$ in $^{-1}$, $k'=-0.76747$, $B=9.2152\times10^{-7}$, and A, C, and D are zero.

Thus, as shown in FIG. 3, the window 24 is, in general, not of constant thickness, although it could be of constant thickness in some special cases. The inner surface 28 is nominally described by the first conic sag relationship, and the outer surface 30 is nominally defined by the second conic sag relationship modified by the addition of at least one aspheric term. The result is that the distance between the inner surface 28 and the outer surface 30 varies as a function of position across the surface of the window 24. In FIG. 3, the relative distances between the inner surface 28 and the outer surface 30 as a function of position across the surface of the window 24 are exaggerated for purposes of illustration.

The window 24 is made of a transparent material selected in conjunction with the operating wavelength of the sensor 32 which is to be protected by the window 24. The sensor 32 may be responsive to, for example, all or part of the ultraviolet, visible, and infrared ranges, and the window 24 must be transparent to the range of interest at which the sensor 32 operates. Transparent materials of construction for windows 24 in specific wavelength transparency ranges are known in the art.

The window 24 is preferably designed and fabricated in the following manner. That is, the following procedure is used to select the constants in the mathematical relationships defining the nominal window surfaces, and to then fabricate and test the window. The basic shape of the window 24 is selected in order to fit with and attach to the structure of the fuselage 22 and to achieve the necessary structural characteristics and mechanical properties. Its outer surface shape is thereafter fine-tuned for acceptable optical performance, within the constraint that the inner surface 28 must remain a conicoidal shape. Once designed, the window is thereafter fabricated and tested.

Figure 4:
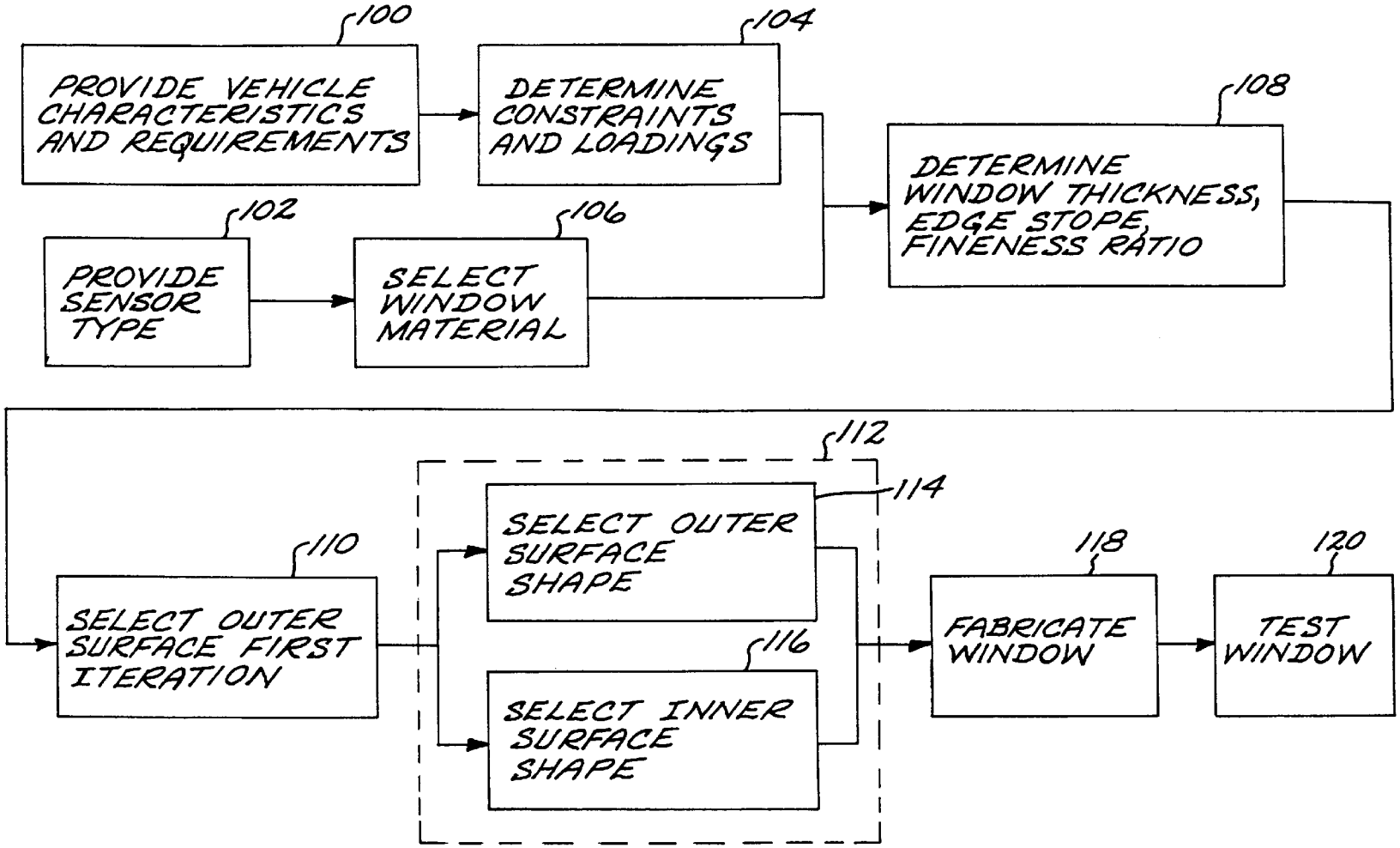
FIG. 4 is a block flow diagram for an approach to designing and manufacturing the window.

FIG. 4 illustrates this process in greater detail. The shape of the fuselage 22, the shape and size of the opening therein for the window 24, and the nature of the mission (velocity, altitude, and other flight parameters) are provided, numeral 100, and the nature of the sensor is provided, numeral 102. These are system requirements established prior to the selection of the window and according to the design and mission of the missile. From the information of box 100, the physical size and constraints on the window 24 are determined, as well as aerodynamic and aerothermal loadings on the window, numeral 104. This information is determined from geometrical considerations and conventional aerodynamics and aerothermal analysis. From the type of sensor, numeral 102, the material of the window 24 is selected from available materials which are sufficiently transparent to energy at the operating wavelength(s) of the sensor and have acceptable mechanical properties, numeral 106. Such materials and their properties for sensor wavelength(s) of interest are known in the art.

Figure 5:
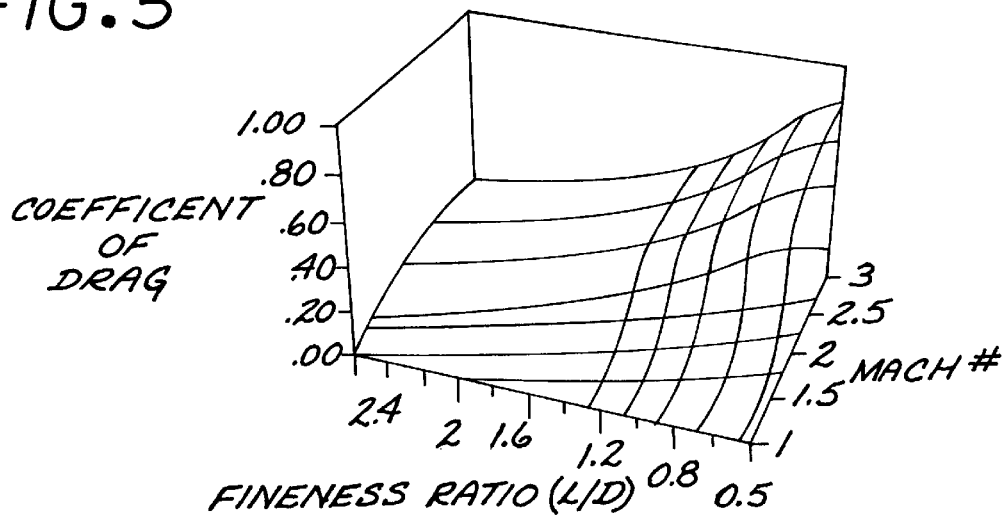
FIG. 5 is a graph of coefficient of drag of a dome-type window.

The physical size (i.e., diameter) and edge slope of the window, such that it fairs smoothly into the shape of the fuselage, is determined geometrically, together with the thickness and fineness (length-to-diameter) ratio of the window, numeral 108. The fineness ratio is the ratio of the length to diameter of the window (where the diameter is the cross sectional distance along the plane at which the window section is cut by the base conic surface). The aerodynamic performance of a nose dome window (as in FIG. 1B) protruding symmetrically into an airstream as a function of the velocity of the missile in Mach number and fineness ratio, as shown in FIG. 5. The selection of the fineness ratio is made to achieve an acceptably low coefficient of drag at the service velocity of the missile. The window must also have sufficient structural strength, fit within the geometric area of the surface of the fuselage that is provided, and be sufficiently large to receive the optical train and sensor.

An approximate conicoidal shape for the outer surface 30 is determined to meet the diameter, edge slope, and fineness ratio requirements, numeral 110. In this step, approximate conic sag coefficients for the outer surface 30 are determined to match the approximate conicoidal shape to the required geometry of the window. In this first design iteration, the coefficients are only approximations, because the exact shape of the outer surface 30 will be later modified with aspheric terms.

The detailed optical design of the inner surface 28 and the outer surface 30 window is then performed, numeral 112. In the optical design, conventional design codes are used to select the constants for the above-described shape equations, keeping in mind that the shape of the inner surface 28 is constrained to be a conicoidal shape. This limitation is established to facilitate subsequent testing, as will be described. The shape of the outer surface 30 is permitted to depart from the approximate conicoidal form established in step 110 in order to provide the necessary shape for optical performance. The result is a change in the shape of the outer surface 30 and in the fineness ratio of the window 24. However, as seen in FIG. 5, the coefficient of drag is a relatively slowly varying function of the fineness ratio and the Mach number. The relatively small difference in shape resulting from the inclusion of the aspheric terms of the outer surface shape does not materially affect the aerodynamic performance of the window.

However, the optical properties of the window are a strongly varying function of the overall shape of the window and the relative shapes of the inner and outer surfaces. The nominal shape of the outer surface, numeral 114, and the inner surface, numeral 116, are therefore established by utilizing optical design codes to calculate ray paths of energy passing through sectors of the window, to minimize the aberration of an image viewed through the window. The design of optical elements such as lenses and windows using such design codes is well established in the art. See, for example, Donald P. Feder, "Automatic Lens Design Methods," *J. Optical Society of America*, vol. 47, No. 10 (1957), pages 902–912, and G. W. Forbes, "Optical system assessment for design: numeral ray tracing in the Gaussian pupil," *J. Optical Society of America A*, Vol. 5, No. 11 (1988), pages 1943–1956. Examples of commercially available optical design codes include "Code V" by Optical Research Associates, "OSLO" by Sinclair Optics, and "ZEEMAX" by Focus Software.

Using the design code, the RMS spot size, wavefront aberration, or other performance criteria of the image when viewed through the window and optical train are assessed and optimized. The nominal shape of the outer surface 30 is determined as that shape which minimizes the RMS (root mean square) spot size or wavefront aberration. In a convenient mathematical implementation preferably used by the inventors, the shape of the outer surface 30 is the second conic sag modified by aspheric terms, as discussed previously. However, other aspheric mathematical forms may be used in the description of the window shape, and these other mathematical forms are equivalent to the present approach for these purposes. Using the design code, the nominal shape of the inner surface 28 is conveniently determined as the first conic relationship.

After the nominal inner and outer shapes are defined, the window is fabricated, numeral 118. Techniques for manufacturing windows of various materials are known in the art. In one approach, molds for the inner and outer surface are made, and the material of the window is cast into the space between these molds. In another approach, the material of the window is machined to the desired shape.

After manufacturing, the window is tested, numeral 120, preferably using procedures to be described next. The prior discussion has dealt with the procedure for determining the "nominal" shapes of the inner and outer surfaces. When a window is manufactured from the transparent material, there are inevitably deviations from the desired nominal values and shapes. If those deviations are too large, the performance of the window becomes unacceptable and the window cannot be used or must be reworked to bring the deviations within acceptable limits. The allowable tolerances may be calculated mathematically from the optical design codes. One of the costly procedures in the manufacture of optical systems of this type is determining whether the actual shapes of the surfaces of the actual manufactured window exceed the allowable dimensional tolerances for acceptable optical performance. If they do exceed the allowable tolerances, the window cannot be used in that form.

Figure 6:
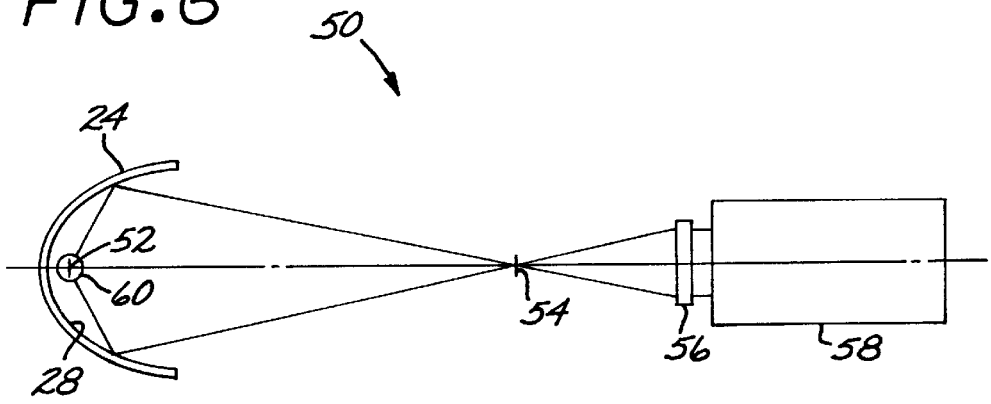
FIG. 6 is a schematic diagram of an apparatus for testing the window.

The present approach facilitates the determination of the actual shapes of the inner and the outer surfaces of the manufactured windows, and thence the determination of whether the window is within the allowable tolerances. FIG. 6 illustrates a preferred apparatus 50 for making these determinations. The first conicoidal mathematical form of the nominal shape of the inner surface 28 has two foci, an adjacent focus 52 that is close to the window 24 and a remote focus 54 that is remote from the window 24. If the inner surface of the actual manufactured window has the perfect nominal mathematical form of the first conicoidal relationship, light emitted from the remote focus 54 is reflected from all points on the inner surface 28 to the adjacent focus 52. The light may be reflected from a sphere at the adjacent focus 52, back along the same ray path to the inner surface 28 and the remote focus 54, and there measured. If, however, there is a deviation in the actual inner surface manufactured shape from the nominal conicoidal shape, the ray paths of beams reflected from the various points on the actual inner surface 28 do not focus precisely in phase back at the remote focus 54. The extent of variation in the shape of the inner surface is determined by focusing the rays to a spherical ball 60 at the adjacent focus 52 using a lens 56 and into an interferometer 58. If the extent of variation of the inner surface 28 is less than the allowable dimensional tolerance for all points, as determined by counting interference fringes of a reference beam and the reflect beam at the interferometer 58, the actual shape of the inner surface is acceptable. If the tolerances are exceeded, the inner surface 28 of the window 24 may be reworked or, in some cases, the window must be scrapped.

After the shape of the inner surface 28 is established, the shape of the outer surface 30 is determined by measuring the thickness of the window 24 between the inner surface 28 and the outer surface 30. From that information, the actual values of the constants in the second conicoidal form modified by the at least one aspheric term are determined. If these constants are within the allowed dimensional tolerances, the window is acceptable for use. Other testing procedures such as interferometry, sub aperture interferometry, and profilometry may also be used, as appropriate.

Figure 7:
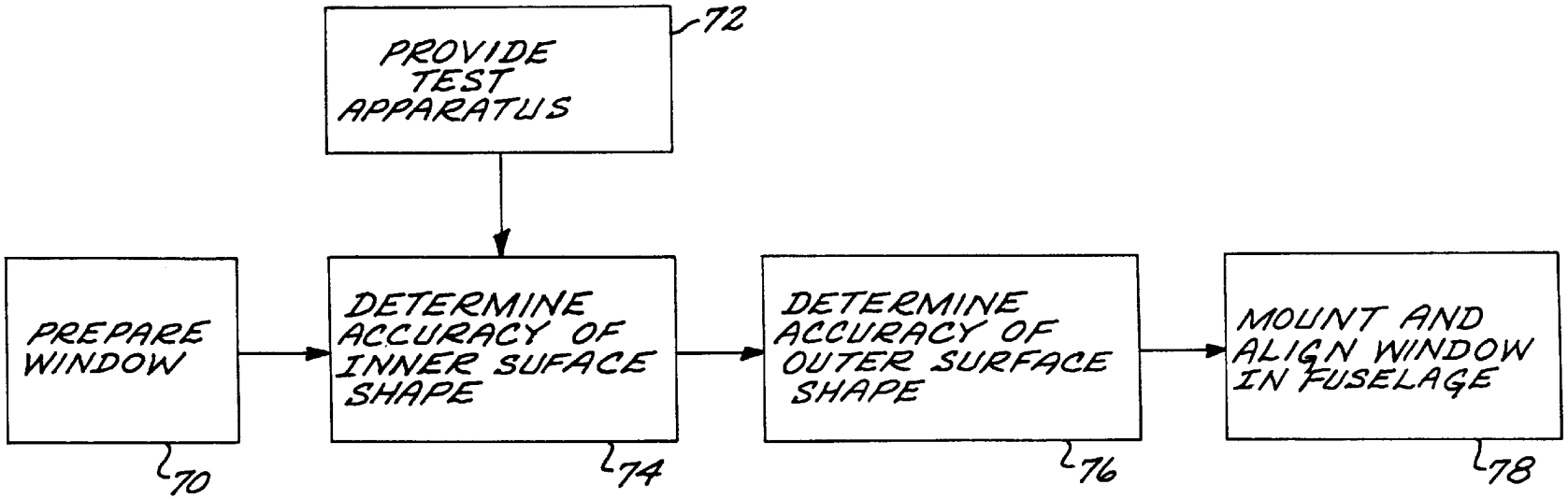
FIG. 7 is a block flow diagram of an approach to testing and aligning the window.

FIG. 7 illustrates the steps followed in the above-described approach of the invention for testing and installing the window 24 in the fuselage 22. The window is prepared using the design approach discussed above and then fabricated to the determined shape using any operable approach, numeral 70, but preferably that discussed above in relation to FIG. 4. The test apparatus 50 is provided, numeral 72. The accuracy of the actual inner surface shape is determined, numeral 74. If it is within the permitted tolerances, the accuracy of the actual outer surface shape is determined, numeral 76. If both actual surfaces are within the accuracy tolerances, the window 24 is judged acceptable, and is mounted and aligned in the fuselage 22, numeral 78. To achieve the installation with the optical system 26 properly aligned, an apparatus like that of FIG. 6 may be used in the optical system of FIG. 2, in place of the optical train 36 and the sensor 32. Once the alignment is achieved, the elements 56, 58, and 60 are removed, and the elements 36 and 32 are installed in with body of the missile 20. The optical system 26 is thereby precisely aligned.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An optical system comprising a flight vehicle having a fuselage;

a window attached to the fuselage of the flight vehicle and made of a curved piece of a transparent material having an inner surface and an outer surface, the inner surface having a nominal inner surface shape defined by a conicoidal mathematical relationship, and the outer surface having a nominal outer surface shape defined by a general aspheric mathematical relationship; and a sensor system positioned within the fuselage at a location closer to the inner surface than to the outer surface, the sensor system including a sensor having an electrical output, an electronics device within the fuselage that receives the electrical output of the sensor, and an optical train positioned between the window and the sensor.

2. The optical system of claim 1, wherein the nominal inner surface shape has a mathematical form $$z=c\rho^2/(1+(1-(1+k)c^2\rho\mathbf{2})^{1/2},$$

where z is the distance along an axis of symmetry of the inner surface, ρ is the distance from the axis of symmetry to the inner surface, and k and c are constants.

3. The optical system of claim 1, wherein the nominal outer surface shape has a mathematical form $$z'=c'\rho^2/(1+(1-(1+k)c'^2\rho'^2)^{1/2}+A\rho'^4+B\rho'^6+C\rho'^8+D\rho'^{10},$$

where z' is the distance along an axis of symmetry of the outer surface, ρ is the distance from the axis of symmetry to the outer surface, and k', c', A, B, C, and D are constants.

4. The optical system of claim 1, wherein the transparent material is transparent to ultraviolet energy.

5. The optical system of claim 1, wherein the transparent material is transparent to visible light.

6. The optical system of claim 1, wherein the transparent material is transparent to infrared energy.

7. The optical system of claim 1, further including:

a sensor sensitive to energy of an operating wavelength, the sensor being positioned closer to the inner surface of the window than to the outer surface, and wherein the transparent material is transparent to energy of the operating wavelength.

8. The optical system of claim 7, further including an optical train positioned between the inner surface of the window and the sensor.

9. An optical system comprising a flight vehicle having a fuselage;

a window attached to the fuselage of the flight vehicle and made of a curved piece of a transparent material having an inner surface and an outer surface, the inner surface having a nominal inner surface shape defined by a first mathematical relationship of the form $$z=c\rho^2/(1+(1-(1+k)c^2\rho 2)^{1/2},$$

where z is the distance along an axis of symmetry of the inner surface, ρ is the distance from the axis of symmetry to the inner surface, and k and c are constants, and the outer surface having a nominal outer surface shape defined by a second mathematical relationship of the form $$z'=c'\rho^2/(1+(1-(1+k)c'^2\rho'^2)^{1/2}+A\rho'^4+B\rho'^6+C\rho'^8+D\rho'^{10},$$

where z' is the distance along an axis of symmetry of the outer surface, ρ is the distance from the axis of symmetry to the outer surface, and k', c', A, B, C, and D are constants; and a sensor system positioned within the fuselage at a location closer to the inner surface than to the outer surface the sensor system including a sensor having an electrical output, an electronics device within the fuselage that receives the electrical output of the sensor, and an optical train positioned between the window and the sensor.

10. The optical system of claim 9, wherein the transparent material is transparent to ultraviolet energy.

11. The optical system of claim 9, wherein the transparent material is transparent to visible light.

12. The optical system of claim 9, wherein the transparent material is transparent to infrared energy.

13. The optical system of claim 9, further including:

a sensor sensitive to energy of an operating wavelength, the sensor being positioned closer to the inner surface of the window than to the outer surface, and wherein the transparent material is transparent to energy of the operating wavelength.

14. The optical system of claim 13, further including an optical train positioned between the inner surface of the window and the sensor.

* * * * *